US007025051B1

(12) United States Patent
Gallops, Jr.

(10) Patent No.: US 7,025,051 B1
(45) Date of Patent: Apr. 11, 2006

(54) DOUBLE CONSTRAINT ARCHERY BOW LIMB LOCATING SYSTEM

(75) Inventor: Henry M. Gallops, Jr., Gainesville, FL (US)

(73) Assignee: SOP Services, Inc., Las Vegas, NV (US)

( * ) Notice: Subject to any disclaimer, the term of this patent is extended or adjusted under 35 U.S.C. 154(b) by 0 days.

(21) Appl. No.: 10/984,170

(22) Filed: Nov. 9, 2004

(51) Int. Cl.
*F41B 5/00* (2006.01)

(52) U.S. Cl. ..... 124/23.1

(58) Field of Classification Search ..... 124/23.1, 124/25.6
See application file for complete search history.

(56) References Cited

U.S. PATENT DOCUMENTS 3,055,353 A 9/1962 Perrucci
4,974,576 A 12/1990 Morey et al.
5,099,819 A 3/1992 Simonds et al.
5,231,970 A 8/1993 Ploot et al.
5,464,001 A 11/1995 Peck
5,487,373 A * 1/1996 Smith ..... 124/23.1
5,592,929 A 1/1997 Hoyt, Jr.
5,682,871 A 11/1997 Walk et al.
5,697,355 A 12/1997 Schaffer
5,697,358 A 12/1997 Campisi
5,803,070 A * 9/1998 Martin et al. ..... 124/88
6,024,076 A 2/2000 Laborde et al.
6,244,259 B1 6/2001 Adkins
6,382,201 B1 5/2002 McPherson et al.
6,470,870 B1 10/2002 Schaar
6,543,432 B1 * 4/2003 Andrews et al. ..... 124/23.1
6,571,785 B1 * 6/2003 Choma ..... 124/25
6,718,963 B1 4/2004 Wheeler
6,758,204 B1 7/2004 Goff et al.
6,886,549 B1 * 5/2005 McPherson ..... 124/23.1
2004/0112354 A1 6/2004 McPherson

* cited by examiner

*Primary Examiner*—John A. Ricci
(74) *Attorney, Agent, or Firm*—Woodard, Emhardt, Moriarty, McNett & Henry LLP

(57) ABSTRACT

Certain preferred embodiments of the present invention use a dual constraint system to align an archery bow limb with a limb cup on a riser. Preferably the limb is aligned so that the centerline of the limb is aligned with the centerline of the riser. The plane of the limb is also constrained to facilitate this centerline alignment and to prevent excessive clearance between the limb, limb pocket and corresponding riser. In certain preferred embodiments, the present invention uses taper or wedge geometry in both the X-Y and X-Z planes along the length and separately along the depth of the limb cup engagement with the archery bow limb. Preferably this provides two complimentary locking mechanisms between the limb and limb cup.

22 Claims, 5 Drawing Sheets

DOUBLE CONSTRAINT ARCHERY BOW LIMB LOCATING SYSTEM

FIELD OF THE INVENTION

The present invention relates to archery bows, and in preferred embodiments provides a bow and a limb pocket for aligning a limb for a compound archery bow.

BACKGROUND OF THE INVENTION

The present invention deals primarily with compound archery bows, generally including a bow frame having a riser and two bow limbs, plus a cable system on the frame mounted to at least two rotational elements such as wheels. For a bow to tune and shoot properly, it is necessary to have the centerlines of the limbs and riser substantially aligned in the same vertical plane. If the centerlines are out of plane such that the limb leans, it will either create excess string clearance in relationship to the riser, which will make the arrow hard to tune, or there will be insufficient clearance, which will allow the vanes or feathers to strike the riser as the arrow exits the bow. It is also important for the limbs to be securely mounted to the riser to prevent movement of the limb ends.

The alignment of the limbs and riser depends on the engagement of the limb to the limb cup and the limb cup to the riser. One past method of aligning the limb to the limb cup used spherical balls placed between the portions to engage the limb with the limb cup. In order to do this, it was necessary to machine concave detents in the limb to engage the balls. Matching detents were machined in the limb cup. This had detrimental effects on the limb because the detents cut the fibers in the limb and created an area that could potentially fail when the limb was flexed.

Another method of locating limbs and the limb cup involved engaging the limb sides with the limb cup. The opposing sides of the limb and limb cup were machined to substantially the same dimension for the limb to be held between the limb cup sides. If the limb cup was not machined to the exact dimension of the limb there would either be excessive clearance which meant the limb would lean, or if the limb cup was machined undersize, the limb would not fit in the limb cup.

It is also important to ensure that adequate contact area and engagement between the limb, riser, and limb cup is maintained. If there is excessive or insufficient contact and engagement, the limb end may flex in relation to the limb cup, which may interfere with the correct functioning of the bow.

An improved bow limb locating system is desired.

SUMMARY OF THE INVENTION

Certain preferred embodiments of the present invention use a dual constraint system to align an archery bow limb with a limb cup on a riser. Preferably the limb is aligned so that the centerline of the limb is aligned with the centerline of the riser. In certain preferred embodiments, the present invention uses taper or wedge geometry along the length and separately along the depth of the limb cup engagement with the archery bow limb. Preferably this provides two complimentary locking mechanisms between the limb and limb cup.

This limb side draft or taper is matched and engaged along the X-Z depth of the limb pocket and/or limb boot. Further preferably, the limb proximal end portion is sized to matingly engage the taper of the limb cup and limb boot along the X-Y length of the pocket.

Objects of certain preferred embodiments of the present invention will become apparent from the description, figures and claims herein.

DESCRIPTION OF THE FIGURES

FIG. 3B is viewed along sectional line 3B—3B in FIG. 1.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Certain preferred embodiments of the present invention use a dual constraint system to align an archery bow limb with a limb cup on a riser. Preferably the limb is aligned so that the centerline of the limb is aligned in a plane with the centerline of the riser. The plane of the limb end is also constrained to facilitate this centerline alignment and to prevent excessive clearance between the limb, limb pocket and corresponding riser. In certain preferred embodiments, the present invention uses taper or wedge geometry in both the X-Y and X-Z planes along the length and separately along the depth of the limb cup engagement with the archery bow limb. Preferably this provides two complimentary locking mechanisms between the limb and limb cup.

Figure 1:
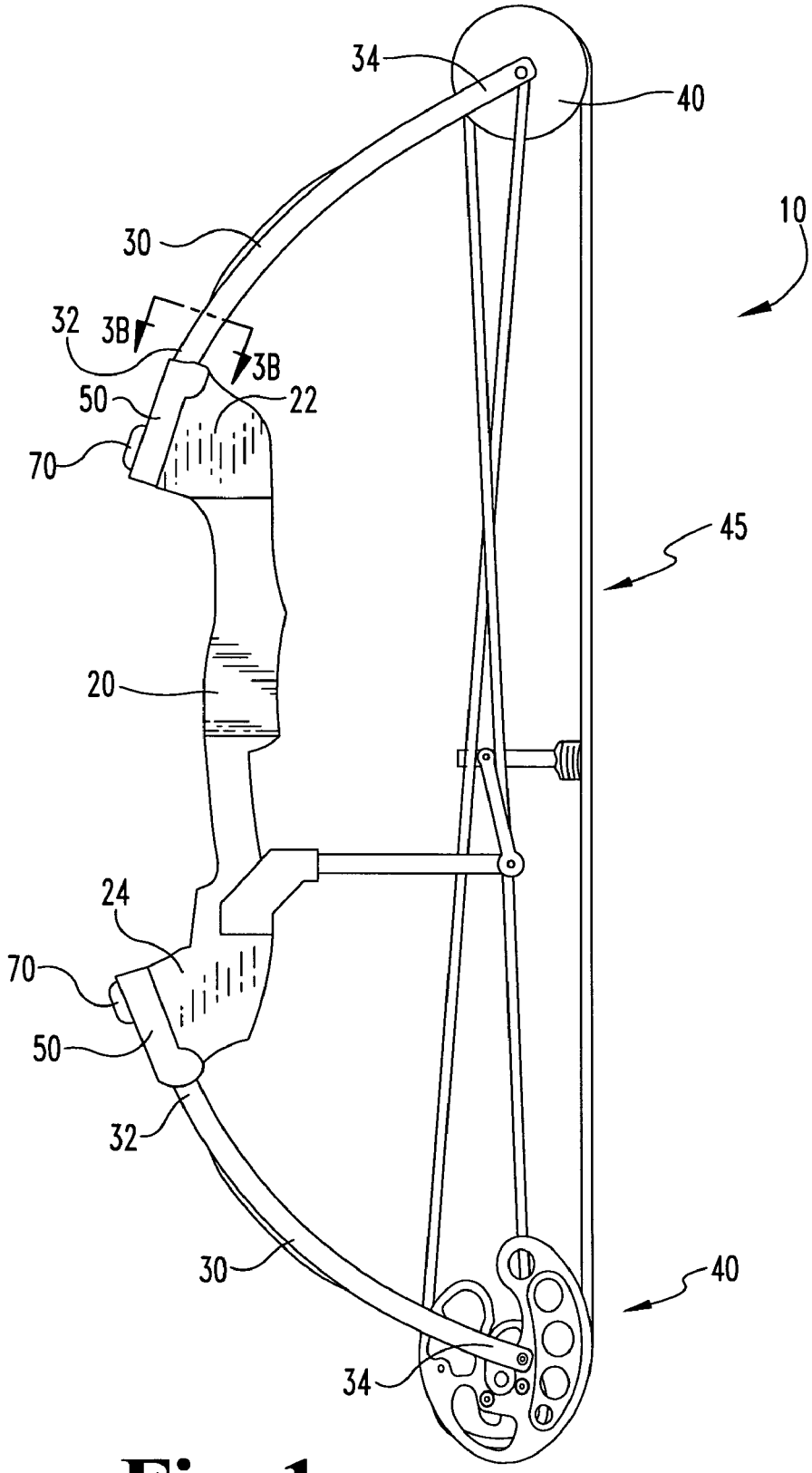
FIG. 1 illustrates a bow according to a preferred embodiment of the present invention.

Typically a compound bow 10 (FIG. 1) includes a riser 20 with an upper end 22 and a lower end 24. Two limbs 30 extend from the riser 20 with proximal ends 32 secured to the upper and lower ends of the riser respectively. Proximal ends 32 are held in limb cups 50 mounted to the upper and lower ends of the riser. Typically a bolt 70 secures the limb end in the limb cup and to the riser. Rotational elements 40 such as wheels, pulleys or cams are mounted on axles adjacent the distal ends 34 of the limbs, and a cable system 45 with a bowstring portion is arranged between the rotational elements 40. As the bowstring portion of the cable system is drawn and "let-out" by the rotational elements, the limb tips resiliently and flexibly travel towards each other, storing energy in the limbs and are controlled and held by the cable system. When the bowstring is released, the limb tips spring back into place, taking up the cable system and imparting energy to an arrow nocked to the bowstring portion.

Directions referred to herein, such as forwardly, rearwardly, vertically and horizontally are intended to be from the perspective of an archer holding an archery bow and are not intended to be absolute. The bow is considered to be held in a substantially vertical position for use, with the bowstring and riser generally considered vertical. Forwardly refers to the direction from the bowstring towards the riser in which direction the arrow is intended to leave the bow. Rearwardly refers to the direction extending from the riser towards the bowstring and the archer. Other directional references are intended to apply from this perspective.

Preferred embodiments of the present invention can be used with "one cam," "two cam" or "Cam&½®" style bows. Preferred embodiments of the invention can also be used with bows having limb pockets in various "rake angles" diverging from vertical. A one cam bow (shown in FIG. 1) typically has one eccentric cam at one limb tip, and a circular idler wheel at the opposing limb tip. The idler is typically mounted to the upper limb and the cam mounted to the lower limb; however, this can be reversed if desired. One example of a one-cam style bow is taught in U.S. Pat. No. 5,368,006, incorporated herein by reference.

A two cam system uses mirror imaged cams that must be kept in perfect time or synchronization in order to function properly. A "Cam&½®" or "one & one half cam" hybrid style system, does not use a circular idler wheel, and instead uses two hybrid cams. Like a two-cam system, a Cam&½ style system needs to be timed in order to shoot properly. Unlike a two-cam system, a Cam&½ style system uses cams that are not a mirror image of one another. A one-cam style system is described as an example, and is not intended to be limiting.

Figure 2:
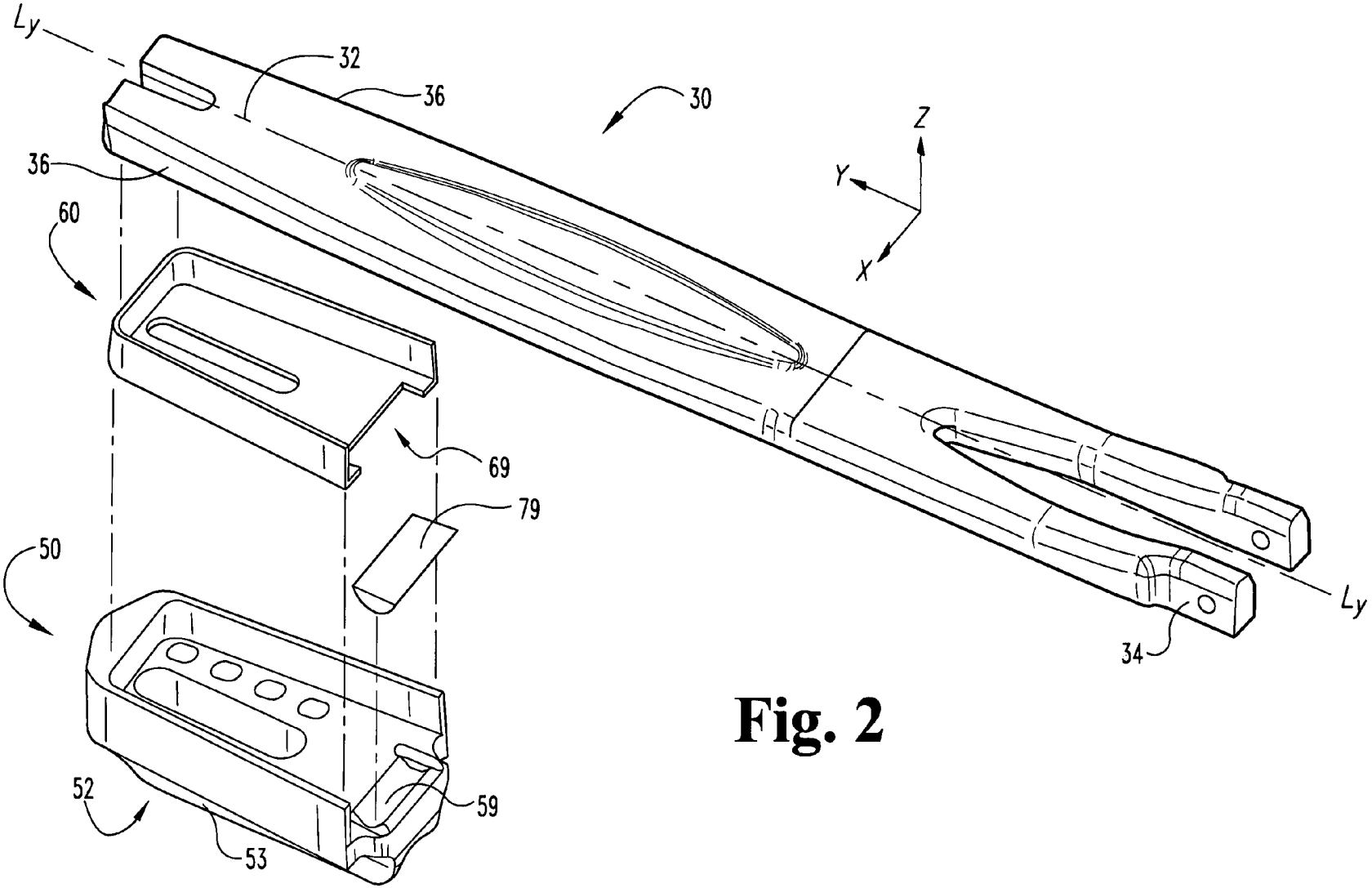
FIG. 2 illustrates an exploded view of a limb and limb pocket assembly according to a preferred embodiment of the present invention.

An exploded view of a limb cup-to-limb assembly is illustrated in FIG. 2. A limb 30 is provided which may be an upper or lower limb for archery bow 10. Limb 30 includes a proximal end 32 to be secured to the riser and a distal end 34 generally secured to a rotational element and cable system. A limb cup 50 is typically mounted at an upper or lower end of riser 20 (FIG. 1) to receive proximal end 32 of limb 30. Optionally, although not required, a limb boot 60 is situated between limb cup 50 and limb 30. Preferably a resilient limb boot 60 assists in dissipating vibrations that would otherwise be transmitted through the limb to the riser and shooter when the bow was shot. In a preferred option, a rocker 79 is received in a rocker cup 59 in limb cup 50 and operates as a fulcrum between limb cup 59 and the lower side of limb 30.

Figure 3A:
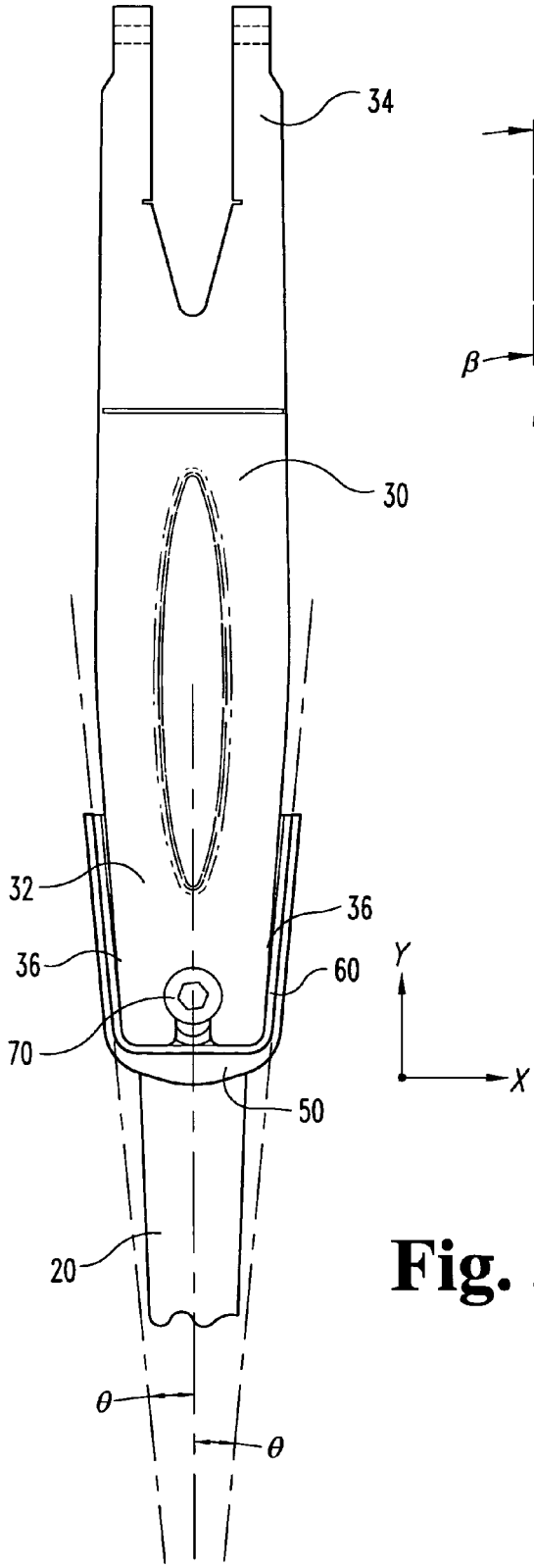
FIGS. 3A and 3B are top and cross-sectional profiles of the assembled limb and limb pocket shown in FIG. 2.
Figure 4B:
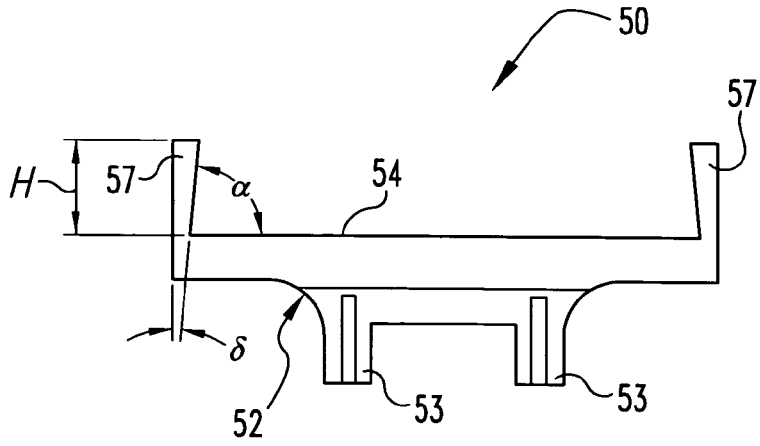
FIGS. 4A and 4B are top and cross-sectional profiles of the limb pocket shown in FIG. 2.
Figure 4A:
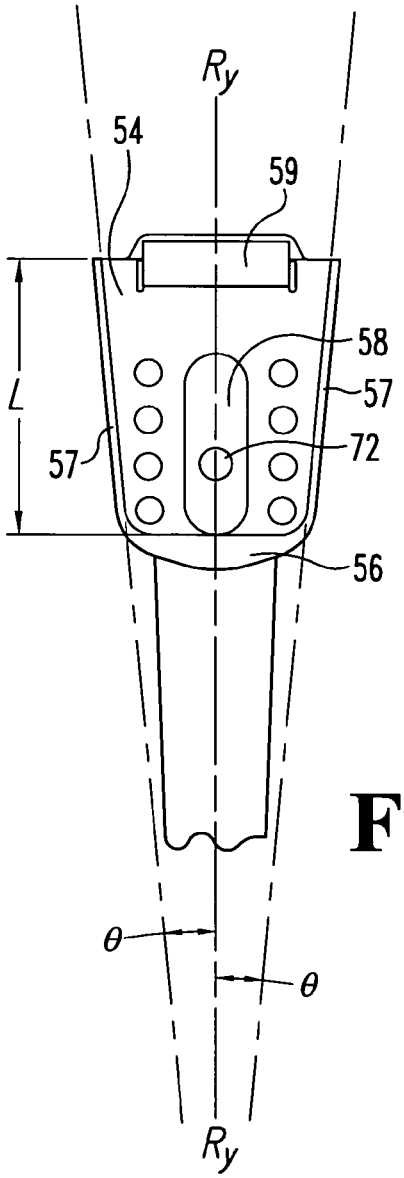

A bolt 70 (FIGS. 1 and 3A) typically is mounted with a cap head outward of limb 30 and extends through a slot in end 32, through openings in limb boot 60 and limb cup 50 and into a threaded bore 72 in riser 20 (FIG. 4A). Bolt 70 anchors and secures limb 30 and the limb pocket 50 to riser 20. Bolt 70 counters the proximal end lever arm of the limb 30, using rocker 79 or the limb cup end as a fulcrum, and restrains the limb end from moving, forcing limb 30 to bend under cable tension as the bow is drawn.

For purposes of reference, limb 30 can be considered as having a longitudinal length between proximal end 32 and distal end 34 directed in a Y-axis. The X-axis is directed between opposing sides 36 of limb 30, such that the X-Y plane is substantially parallel to the plane of limb 30. If limb 30 is curved, the X-Y plane referenced herein is the plane substantially parallel in passing through proximal end 32. The Z-axis is considered perpendicular to the X-Y plane and is perpendicular to the limb cup and proximal end 32 of limb 30 through or parallel with bolt 70. Limb 30 defines a longitudinal central axis $L_y$ between proximal end 32 and distal end 34.

Figure 3B:
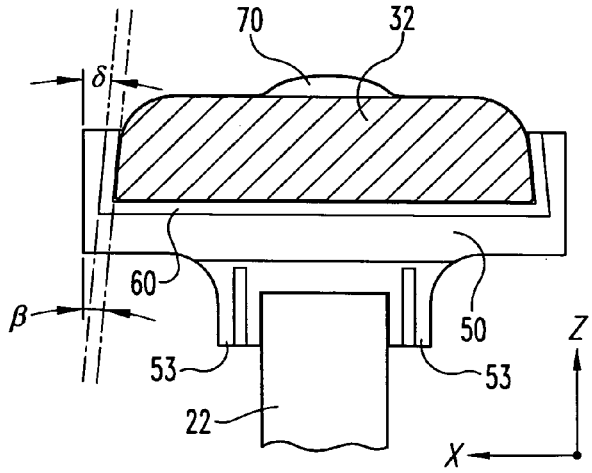

FIG. 3A shows a front view of a limb, limb pocket and riser. Limb 30 includes proximal end 32 received and aligned in limb pocket 50 with a limb boot 60 situated between the limb end and the limb pocket. Limb pocket 50 is mounted on an end of riser 20. Bolt 70 connects the limb, to riser 20. FIG. 3B shows a partial cross-sectional view of proximal end 32 and limb pocket 50 and limb boot 60. FIG. 3B is a view from the proximal direction along sectional line 3B—3B of FIG. 1, viewed towards the riser.

Limb pocket 50 can be mounted with its centerline aligned with the riser 20 centerline in various ways. For example, the lower side 52 of limb pocket 50 may define a channel between two brackets 53 where the channel receives and aligns the riser end 22 with respect to the limb pocket. The limb pocket may be secured to the riser in a fixed or limited pivot arrangement. The connection may be solid, for example by welding, or the connection may be disassembable, for example using screws, bolts or rivets. The connection may extend along all or a potion of the length of the pocket, and may include one, two or more engagement sections. In some options, certain sections of the limb boot may be spaced apart from the riser.

FIGS. 4A and 4B illustrate limb pocket or bracket 50 on riser 20 in greater detail. Limb pocket 50 includes a base plate or seat portion 54 having a front direction toward the riser and a rear direction oriented toward the proximal end of the limb. Seat portion 54 is typically flat or planar with an outward face. Optionally, a front wall 56 closes the front end of limb pocket 50. Seat portion 54 defines a length L of the pocket extending from the front end of the seat portion towards the rear end of the seat portion. Sidewalls 57 rise on opposing sides of seat portion 54 and define a height H or depth for the seat pocket 50. Seat pocket 50 further includes a mounting opening 58 for bolt 70 to pass through the limb pocket and into riser bore 72. Optionally, a defined rocker cup 59 is arranged to receive optional rocker 79.

Preferably sidewalls 57 define an outward taper along the length L of the limb pocket 50 in the X-Y plane. This taper is typically narrowest at the front portion and widens in the rearward direction. The taper preferably matches a corresponding X-Y taper on the outer edges 36 of limb proximal end 32. Preferably sidewalls 57 define a symmetric X-Y taper at an angle θ on opposite sides of a riser centerline $R_y$ defined by the limb pocket and riser. In preferred embodiments, angle θ is in a range of 1 degree to approximately 11 degrees, and in a preferred embodiment is approximately 11 degrees.

In a preferred embodiment, sidewalls 57 of limb pocket 50 define a second or X-Z taper on the inward sides of the pocket. Preferably the sidewalls 57 are tapered inward from the face of seat 54 upward along the height "H" or depth of the pocket. This taper preferably matches a corresponding X-Z taper on the edges 36 of limb proximal end 32 for engagement along the height of the pocket. Alternately, the taper exceeds vertical or tapered limb edges so that the sidewalls 57 engage edges 36 primarily along the front corners of edges 36. In certain preferred embodiments, the inward taper of the sidewalls is angled from vertical at an angle δ between approximately 1 and 20 degrees, with a complimentary angle α between the sidewall and seat portion in a range of approximately 70 to 89 degrees. A preferred angle δ is approximately 10 degrees.

Figure 5B:
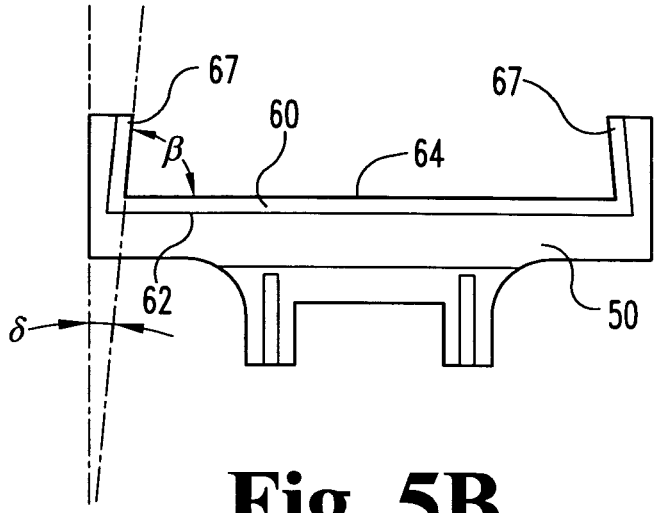
FIGS. 5A and 5B are top and cross-sectional profiles of the limb pocket and limb boot shown in FIG. 2.
Figure 5A:
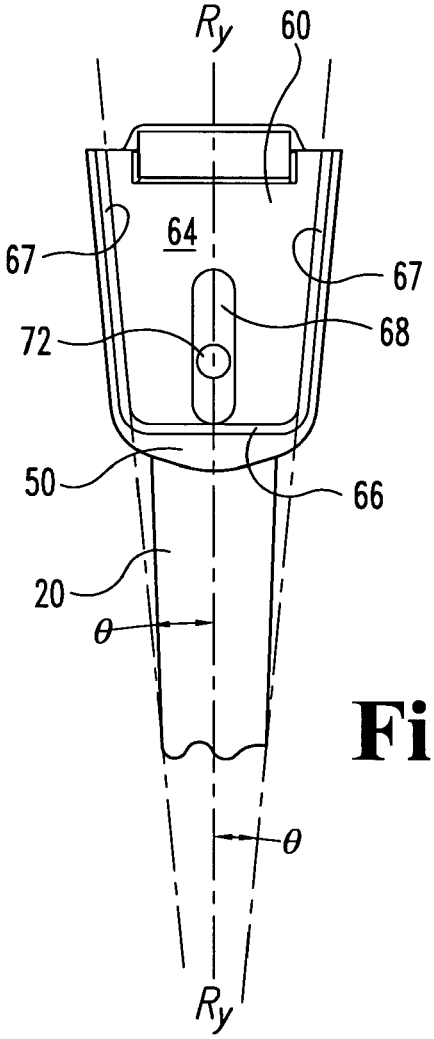

FIGS. 5A and 5B illustrate front and end views of limb pocket 50 with limb boot 60 therein. Limb boot 60 is preferably sized and arranged in limb pocket 50 to be situated between the limb pocket and the proximal end of the limb to absorb and reduce vibration transmission. In a preferred embodiment, the limb boot is relatively thin and made of a partially resilient material such as a medium durometer polyurethane which slightly compresses during insertion of the limb into the pocket and thereby facilitates the wedging and securing action of the pocket to the limb tip.

Limb boot 60 preferably includes seat portion 64 which is substantially flat and parallel with limb pocket seat portion 54. Lower side 62 of seat portion 64 preferably abuts seat 54 and may also engage the upper side of rocker 79 in rocker pocket 59. Limb boot 60 includes opposing side walls 67 which are tapered on the outward side in both the X-Y and X-Z planes to match side walls 57 and preferably are tapered on the interior of the limb boot in parallel with an interior X-Y angle θ and with an X-Z interior angle β to engage the side edges of the limb end. Angle β is preferably comparable to angle δ, and is between 70 and 89 degrees from seat portion 64, providing a compliment angle of 1 to 20 degrees from a vertical axis perpendicular to the limb boot seat portion. Limb boot 60 further preferably includes a bolt opening 68 which allows a bolt 70 to pass through.

In preferred embodiments, the double constraint system between the limb pocket and limb operates to align the limb in two perpendicular planes with respect to the limb pocket. In a preferred embodiment, the X-Y taper of the sidewalls and limb end hold the central axis of the limb $L_y$ is held in vertical alignment with the riser central axis $R_y$ in the X-Y plane. Preferably in a second level of constraint, the X-Z taper of the sidewalls and limb end restrain the proximal flat end of the limb from lifting or twisting in the X-Z plane to also prevent misalignment of the limb and riser. In certain embodiments, the tapered engagements between the limb and limb pocket form a double "wedged" engagement or geometry, when pushed together, in order to securely lock and hold the limb and limb pocket in the desired alignment.

The limb boot 60 may slightly compress under pressure when the limb end is inserted into the limb pocket. After the insertion pressure is released, limb boot 60 may slightly expand to more securely look and align the limb end in the limb pocket.

Preferred embodiments of limbs used in the present invention include compression molded filament wound limbs such as taught by U.S. Pat. Nos. 5,141,689; 5,392,756; 5,501,208; 5,894,835 and 6,142,132 and pending U.S. patent application Ser. No. 10/748,021 filed Dec. 30, 2003 incorporated herein by reference. Sometimes when a limb is compression molded, the side edges of the limb have a slight vertical draft or taper to aid in removal of the limb from the mold. This limb side draft or taper is matched and engaged along all or portions of the height tapered sidewalls and along the depth of the limb pocket and/or limb boot. In certain preferred embodiments, the tapered X-Z limb edge angle is from 1 to 20 degrees from vertical and in a preferred embodiment is approximately 10 degrees. Further preferably, the limb proximal end portion is sized to matingly engage the taper of the limb cup and limb boot along the X-Y length of the pocket.

In an alternate embodiment, not illustrated, the limb pocket and/or limb boot include an outer seat or face portion across the length and the width of the limb pocket which is sized and arranged to pass over the proximal end of the limb when the limb and limb pocket are combined. In certain embodiments, this outer face forms a closed pocket for the limb and further assists in securing the limb and inhibiting escape during flexing of the limb. The limb boot may also have an outer plate or portion. Preferably the anchor bolt passes through the outer plate as well. In a further alternate embodiment, the limb pocket includes an outer face or seat passing over and parallel to the limb end and sidewalls with or without a limb boot, but is open to the riser with or without a limb boot on the lower side. The outer seat can be used to support sidewalls to define a pocket and to assist in defining tapers along the length and height of the defined pocket.

In a still further embodiment, the limb pocket may define two parallel channels with two limb boot channels for receiving two limb portions in a quad style limb. The two channels are each tapered in two directions. The limb pocket and boot may have a fixed center portion with tapered sidewalls or a tapered wedge-style insert may be used between the limb portions.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An archery bow, comprising:

an archery bow riser having a length with an upper end and a lower end;

a pair of bow limbs, each bow limb having a proximal end and a distal end;

a bowstring extending between the distal ends of said limbs;

a limb pocket mounted on one end of said riser and restraining the proximal end of one bow limb, wherein said limb pocket has a seat portion and two opposing sidewall portions with a height defining a length and a depth of said limb pocket;

wherein said limb pocket and said one proximal end of said bow limb have a matched taper along the length of said limb pocket to align said bow limb in a first plane; and, wherein said limb pocket has a taper matching or exceeding a taper of said proximal one end of said bow limb along the depth of said limb pocket to align said bow limb in a second plane perpendicular to said first plane.

2. The archery bow of claim 1, comprising a second limb pocket mounted on the other said end of said riser and containing the proximal end of the second bow limb, wherein said second limb pocket has a seat portion and two opposing sidewall portions with a height defining a length and a depth of said second limb pocket; wherein said second limb pocket and said proximal end of said second bow limb have a matched taper along the length of said second limb pocket to align said second bow limb in a first plane; and, wherein said second limb pocket has a taper matching or exceeding a taper of said second proximal end of said second bow limb along the depth of said second limb pocket to align said second bow limb in a second plane perpendicular to said first plane.

3. The archery bow of claim 1, wherein said limb pocket and said proximal end of said bow limb have an outward taper along the length of said limb pocket from said riser towards the distal end of said bow limb.

4. The archery bow of claim 3, wherein said outward taper is between approximately 1 and 11 degrees from a longitudinal axis defined through the middle of the limb pocket between said side walls.

5. The archery bow of claim 3, wherein said outward taper between said limb pocket and said bow limb aligns a central axis of said bow limb with a central axis of said riser.

6. The archery bow of claim 1, wherein said limb pocket and said proximal end of said bow limb have an inward taper from the seat of said limb pocket along the height of said side walls.

7. The archery bow of claim 6, wherein said inward taper between said limb pocket and said bow limb aligns the plane of said bow limb end with said limb pocket.

8. The archery bow of claim 7, wherein said inward taper is between approximately 1 and 20 degrees from perpendicular to said limb pocket seat.

9. The archery bow of claim 6, wherein said limb pocket and said proximal end of said bow limb have an outward taper along the length of said limb pocket from said riser towards the distal end of said bow limb.

10. The archery bow of claim 9, wherein said limb pocket includes a limb boot situated between said limb pocket and said proximal end of said bow limb.

11. The archery bow of claim 10, wherein the interior of said limb boot is tapered to match said outward taper along the length of the said limb pocket between the limb pocket and said proximal end of said bowlimb and is tapered in a second direction to match said inward taper along the depth of said limb pocket between said limb pocket and said proximal end of said bow limb.

12. A limb pocket for an archery bow, comprising:

a seat portion to be mounted on an archery bow riser defining a front and a rear;

sidewall portions with a height on opposing sides of said seat portion;

said seat portion and said sidewall portions defining a pocket to receive an end of an archery bow limb;

said pocket having a length and a depth;

said pocket having an outward taper along said length from said front towards said rear; and, said pocket having an inward taper along the depth of said limb pocket.

13. The limb pocket of claim 12, wherein said inward taper is defined with the narrowest portion between the heights of said sidewall portions.

14. The limb pocket of claim 13, comprising a resilient limb boot arranged in said pocket wherein said limb boot has two interior tapers matching said outward taper and said inward taper respectively.

15. A limb pocket for an archery bow, comprising a limb pocket bracket mountable on an archery riser and defining a pocket to receive an end of an archery bow limb, said pocket defining at least two tapered directions to wedgingly align the end of the archery bow limb in at least two directions.

16. The limb pocket of claim 15, comprising a resilient limb boot situated in said pocket, wherein said limb boot has an outer surface tapered in at least two directions to match said tapered pocket and wherein said limb boot defines an interior with at least two tapered directions to wedgingly align the end of the archery bow limb in said limb pocket.

17. The limb pocket of claim 15, wherein said limb pocket is tapered along a length to align the central axis of an archery bow limb with a riser central axis and wherein said limb pocket is tapered along a height to align the edges of an archery bow limb end in a second direction.

18. The limb pocket of claim 17, wherein said limb pocket is outwardly tapered along said length.

19. The limb pocket of claim 18, wherein said outward taper is between approximately 1 degree and 11 degrees.

20. The limb pocket of claim 17, wherein said limb pocket is inwardly tapered along said height.

21. The limb pocket of claim 20, wherein said inward taper is between approximately 1 degree and 20 degrees.

22. The limb pocket of claim 21, wherein said inward taper is approximately 10 degrees.

* * * * *